US005458382A

United States Patent [19]

Boadwine et al.

[11] Patent Number: 5,458,382

[45] Date of Patent: Oct. 17, 1995

[54] DEADBOLT LATCH ASSEMBLY

[75] Inventors: W. Daniel Boadwine, Salem; Robert E. Dalton, Jr., Roanoke; Dennis W. Schoonover, Salem; Joey D. Shiplett, Roanoke; John L. Trainor, Fincastle; Steven B. Alley, New Castle; Linda G. Dunahoo, Salem, all of Va.

[73] Assignee: Medeco Security Locks, Inc., Salem, Va.

[21] Appl. No.: 254,880

[22] Filed: Jun. 6, 1994

[51] Int. Cl.[6] ..... E05C 1/16

[52] U.S. Cl. ..... 292/337

[58] Field of Search ..... 292/337, 346, 292/169, DIG. 51, DIG. 54, DIG. 38, DIG. 61, 1.5, DIG. 53; 403/306, 362, 108

[56] References Cited

U.S. PATENT DOCUMENTS

| | | | |
|---|---|---|---|
| 713,227 | 11/1902 | Levalley | 403/362 |
| 1,661,868 | 3/1928 | Armstrong et al. | 403/362 |
| 4,725,086 | 2/1988 | Shen | 292/1.5 |
| 4,736,973 | 4/1988 | Fang | 292/337 |
| 4,974,883 | 12/1990 | Jans | 292/169 |
| 4,999,768 | 12/1990 | Marotto et al. | 292/337 |
| 5,308,131 | 5/1994 | Galindo et al. | 292/DIG. 38 |

*Primary Examiner*—Peter M. Cuomo
*Assistant Examiner*—Monica E. Millner
*Attorney, Agent, or Firm*—Rothwell, Figg, Ernst & Kurz

[57] ABSTRACT

A deadbolt latch assembly capable of accommodating both rectangular faceplates and circular faceplates. The latch housing assembly is provided with a semi-permanent rectangular faceplate assembly attached thereto, but which is removable with a prying tool to allow the housing to accommodate an alternative faceplate such as a circular faceplate. The housing is manufactured of a thick walled steel casing to enclose and retain not only the latch but the latch extension as well, to thereby prevent the latch extension from flexing about the latch-extension joint.

2 Claims, 3 Drawing Sheets

DEADBOLT LATCH ASSEMBLY

BACKGROUND OF THE INVENTION

1. Field of the Invention

This invention relates generally to latch lock assemblies, and more particularly to deadbolt latch housing and faceplate assemblies.

2. Background and Prior Art

Conventionally, deadbolt locks for doors contain a deadbolt latch supported within a cylindrical or tubular latch housing which is mounted in a lateral bore of the door and a lock cylinder mounted in a transverse bore in operational coupled relationship with the deadbolt latch. The latch housing is anchored within the lateral bore by a faceplate which is fixed to the latch end of the housing, and which is securely mounted flush with the door edge surface.

In wooden doors, the faceplate is conventionally rectangular and fits within a mortised or chiseled recess in the door edge circumscribing the lateral bore. The rectangular faceplate is secured to the door edge by a number of screws.

In metal doors, a circular faceplate is conventionally used instead of a rectangular faceplate, since it is not possible to chisel a recess in the edge of a metal door. The circular faceplate may have a plurality of serrations or teeth around its periphery which grab the inner bore surface when hammered flush with the door edge surface.

In the past, such deadbolt latch assemblies have been provided with faceplates permanently fixed to the latch housing. For rectangular faceplate assemblies, a pair of ear tabs extending from the latch end of the housing are sandwiched between the rectangular faceplate and a backing plate fixed to the faceplate. For circular faceplates, the ear tabs were sheared off and the circular faceplate was crimped around the cylindrical surface of the latch housing.

An improvement to the prior art discussed above is disclosed in U.S. Pat. No. 5,094,488, assigned to the same assignee herein. The '488 patent discloses an arrangement wherein a deadbolt latch assembly is provided without a faceplate such that a rectangular or circular faceplate may be attached to the housing at an installation site as appropriate. However, this arrangement requires a specialized rectangular faceplate assembly having a backing plate with special tab slots and spring tabs for snap engaging and locking the ear tabs of the housing permanently in place. Additionally, such an assembly always requires a locksmith or installer to perform the additional step of attaching a faceplate to the housing. There thus exists a need in the art for further improvements to deadbolt latch assemblies.

SUMMARY OF THE INVENTION

The present invention provides an improved deadbolt latch assembly which overcomes the limitations mentioned above.

In particular, the present invention provides a door latch assembly, comprising a latch, a latch extension attached to said latch, a tubular housing enclosing said latch and said latch extension therein, and including attachment means for attaching a faceplate to one end thereof, and a rectangular faceplate assembly including a rectangular faceplate and a backing plate fixed to said rectangular faceplate, said rectangular faceplate assembly being semi-permanently attached to said tubular housing through rigid engagement of said attachment means between said rectangular faceplate and said backing plate, said backing plate further including means for facilitating separation of said rectangular faceplate from said backing plate to enable said rectangular faceplate assembly to be removed from said tubular housing so as to expose said attachment means for attachment of an alternative faceplate assembly to said tubular housing.

In another aspect, the present invention provides a door latch kit containing a latch assembly with a semi-permanently attached rectangular faceplate and a separately provided circular faceplate.

The present invention thus provides a door latch assembly having a simplified rectangular faceplate assembly already attached to the latch housing, and which may be removed for attachment of a circular faceplate as needed. Thus, where installation is to be made in a wooden door, the deadbolt assembly can be mounted in a simplified manner without the need to attach a faceplate to the housing.

According to yet another aspect of the invention, the tubular housing of the assembly encloses both the latch as well as the latch extension (or frame assembly) to thereby prevent the latch extension from flexing and failing about the point where the extension would otherwise meet the housing.

BRIEF DESCRIPTION OF THE DRAWINGS

The present invention will become more fully understood from the following detailed description and accompanying drawings, which are given for purposes of illustration only and are not limitative of the present invention, and wherein.

DETAILED DESCRIPTION OF THE PREFERRED EMBODIMENTS

Figure 1:
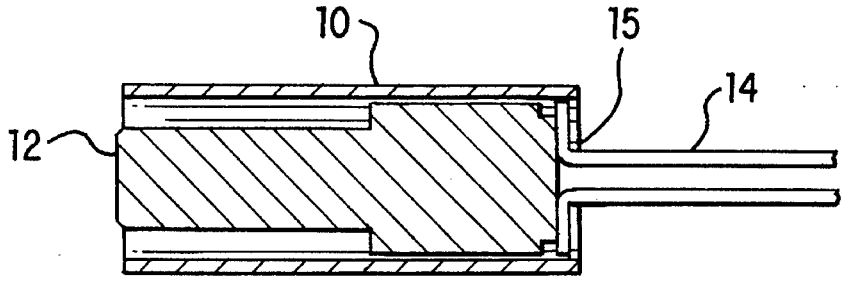
FIG. 1 PRIOR ART
FIG. 1 is a cross-sectional view of a latch housing according to the prior art.

FIG. 1 illustrates a prior art door latch assembly having a latch housing 10, a bolt or latch 12, and a latch extension or frame assembly 14 attached to the bolt 12. The extension 14 contains a slotted hole into which a rod is inserted for rotation by a lock cylinder (not shown), so as to extend and retract the bolt 12 from a receiving hole in the door jamb. The latch housing 10 is made of a thin drawn steel material and is constructed such that the latch extension 14 protrudes therefrom in a fully exposed manner. This construction is deficient in that the exposed extension 14 has a tendency to flex about the joint 15 where the extension meets with the housing 10, ultimately causing the extension to fail.

Figure 2:
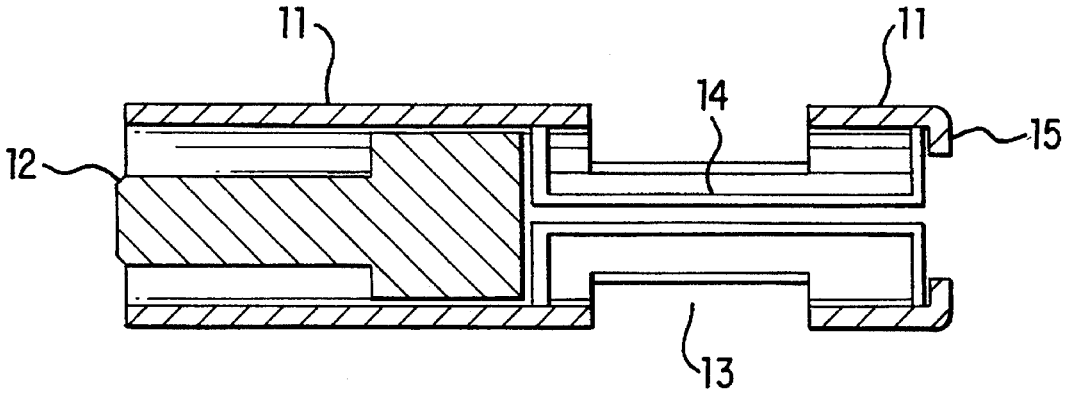
FIG. 2 is a cross-sectional view of a latch housing according to a preferred embodiment of the present invention.
Figure 3:
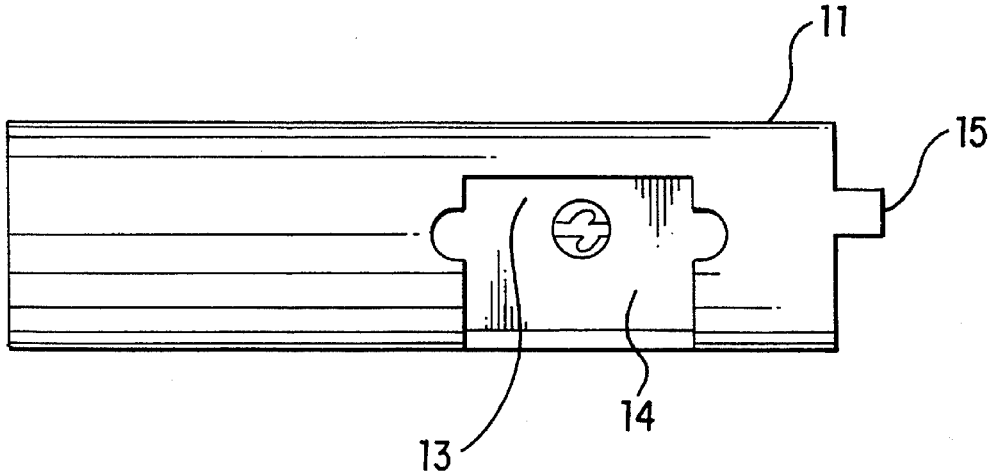
FIG. 3 is a side view of the latch housing of FIG. 2.

In one aspect of the invention as shown in FIGS. 2 and 3, this shortcoming of the prior art is eliminated, by providing a thick walled tubular housing 11 which encloses and retains the bolt extension 14 as well as the bolt 12. The construction of FIGS. 2 and 3 eliminates the weak joint 15 of the prior art and retains the bolt extension 14 completely aligned within the housing. A pair of slots 13 are formed on opposite sides of the tubular housing 11 with semicircular cutouts to accommodate the extension and retraction of the latch 12. The end of the housing 11 includes a plurality of retention tabs 15 for positively retaining the latch extension 14 within the housing, by folding over the end of the extension as shown in FIG. 2. FIG. 3 illustrates one of the tabs 15 in an unfolded position prior to final insertion of the latch and extension into the housing.

Figure 4:
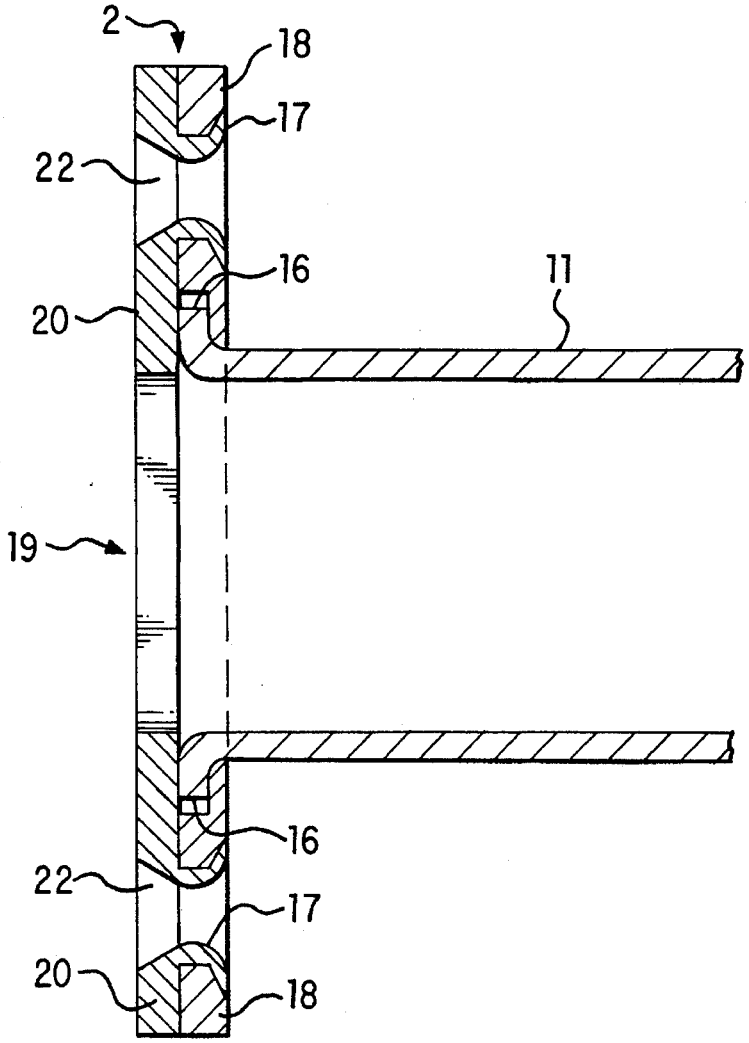
FIG. 4 is a cross-sectional enlarge view of the latch housing according to the present invention illustrating the detail of the rectangular faceplate assembly attachment to the end of the housing.
Figure 6:
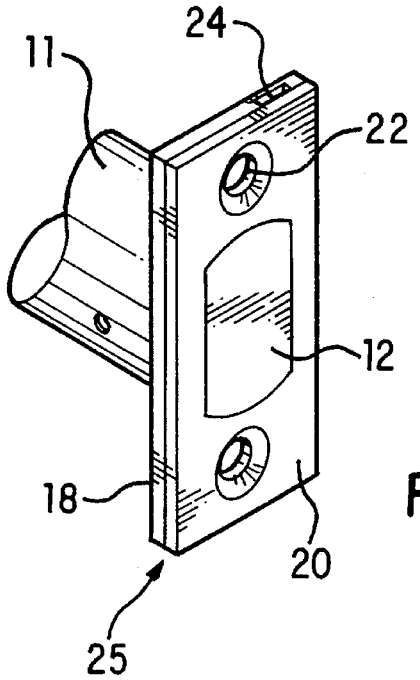
FIG. 6 is a perspective view of the latch housing according to the present invention with the rectangular faceplate assembly rigidly attached thereto.

Turning now to FIGS. 4 and 6, the door latch assembly according to the present invention is also characterized by having a rectangular faceplate assembly 25 that is semi-permanently attached to the latch housing 11 at the factory, and which can be removed at the site of installation for accommodation of a circular faceplate as necessary.

Figure 5:
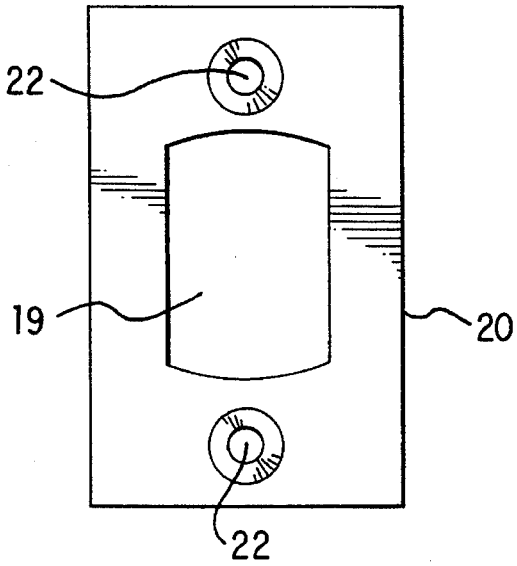
FIG. 5 is a plan view of the rectangular faceplate assembly of FIG. 4.

The semi-permanently attached rectangular faceplate assembly 25 includes a rectangular faceplate 20 and a backing plate 18 fixed to the faceplate 20 by curved ridge portions 17 of faceplate 20 extending from tapered holes 22, which ridge portions grab the backing plate 18 through corresponding holes in the backing plate. Mounting screws are threaded through tapered holes 22 to securely mount the faceplate assembly to the door edge and the attached latch housing within the lateral bore. The inner sections of the backing plate 18 adjacent the opening 19 (and through which the latch 12 protrudes in an extended position) contain notched portions forming securing notches for the ear tabs 16 extending from the end of the tubular housing 11 when the backing plate 18 is fixed to the rectangular faceplate 20. FIG. 5 illustrates a front view of the rectangular faceplate 20.

Figure 7:
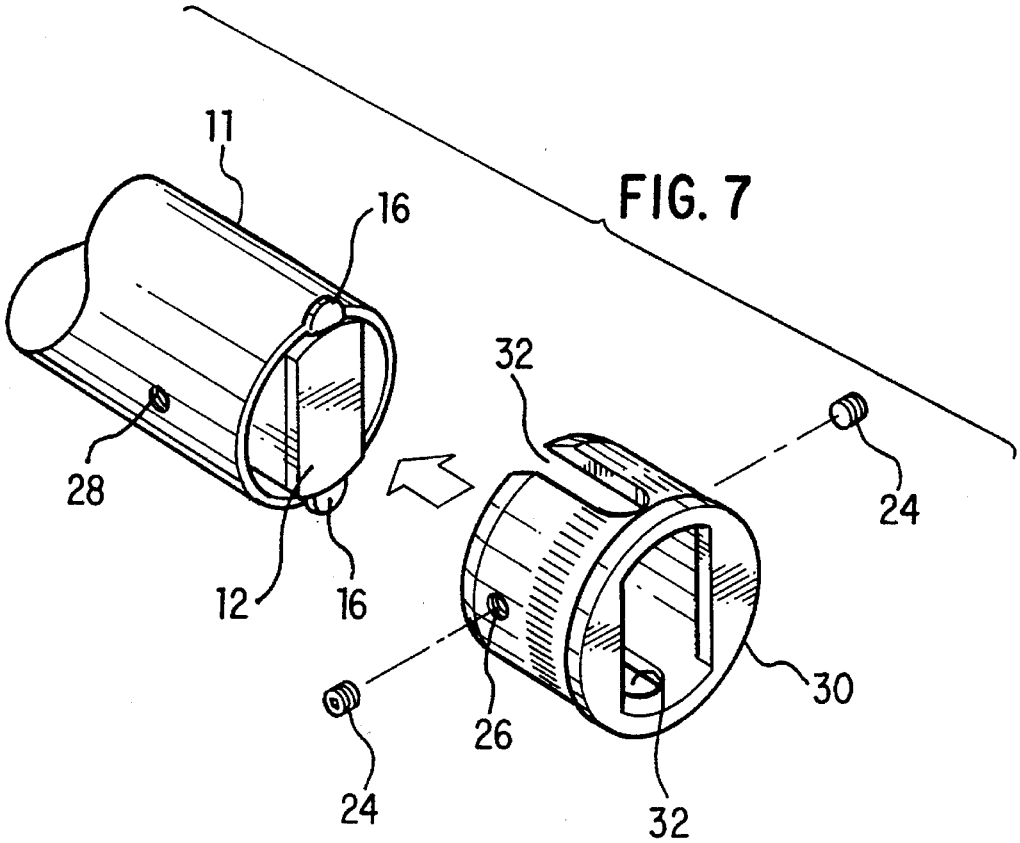
FIG. 7 is a perspective view of the latch housing according to the present invention after the rectangular faceplate assembly has been removed for fitting of a circular faceplate according to the invention.

As shown in FIG. 6, the backing plate 18 is provided with a pair of slots 24, one at the top edge of the backing plate and the other at the bottom edge thereof (only the top one of which is shown in the drawing). As previously explained, the rectangular faceplate assembly is rigidly attached to the tubular housing in a semi-permanent manner at the factory, and is not readily removable from the housing. In order to remove the rectangular faceplate from the housing, a flat edge prying tool such as a screwdriver is inserted into the slots 24 in the backing plate and used as a wedge to pry the rectangular faceplate 20 off the backing plate 18. With the rectangular faceplate removed, the backing plate 18 is easily separated from the tubular housing 11, leaving the ear tabs 16 exposed as shown in FIG. 7.

At this point, a circular faceplate 30 may be positioned on the end of the housing 11 by aligning slots 32 of the circular faceplate with the ear tabs 16 of the housing and sliding the circular faceplate over the end of the housing 11, such that threaded bores 28 on the housing 11 will be aligned with apertures 26 in the circular faceplate 30. The circular faceplate 30 is rigidly fixed to the housing 11 by threading set screws 24 through the apertures 26 and into the threaded bores 28 on the housing. The present invention thus provides a door latch assembly which is able to accommodate different types of faceplates, but which is also installation ready for the more common wooden door, without the need for attaching a separate rectangular faceplate. The present invention is applicable to both deadbolt latch assemblies as well as conventional door knob latch units.

The invention having been thus described, it will be apparent to those skilled in the art that the same may be varied in many ways without departing from the spirit and scope of the invention. Any and all such modifications are intended to be included within the scope of the following claims.

What is claimed is:

1. A door latch assembly, comprising:

a latch;

a latch extension attached to said latch;

a tubular housing enclosing said latch and said latch extension therein, said tubular housing including attachment means for attaching a faceplate to one end thereof and at least one threaded bore on a lateral surface thereof adjacent said attachment means;

a rectangular faceplate assembly including a rectangular faceplate and a backing plate, said faceplate and said backing plate each having at least one corresponding screw hole, said faceplate further including at least one curved ridge portion extending through said screw hole of said backing plate to fix said faceplate to said backing plate, said rectangular faceplate assembly being semi-permanently attached to said tubular housing through rigid engagement of said attachment means between said rectangular faceplate and said backing plate, said backing plate further including means for facilitating separation of said rectangular faceplate from said backing plate to enable said rectangular faceplate assembly to be removed from said tubular housing so as to expose said attachment means for attachment of an alternative faceplate assembly to said tubular housing; and a circular faceplate assembly having means for engaging with said attachment means upon removal of said rectangular faceplate assembly from said tubular housing for positioning said circular faceplate assembly on said tubular housing and said circular faceplate assembly including at least one aperture aligning with said threaded bore upon positioning of said circular faceplate assembly on said tubular housing, such that said circular faceplate assembly is rigidly secured to said tubular housing by threading a set screw through said aperture into said threaded bore.

2. A door latch kit, comprising:

a latch;

a latch extension attached to said latch;

a tubular housing enclosing at least said latch therein, said tubular housing including attachment means for attaching a faceplate to one end thereof and at least one threaded bore on a lateral surface thereof adjacent said attachment means;

a rectangular faceplate assembly including a rectangular faceplate and a backing plate, said faceplate and said backing plate each having at least one corresponding screw hole, said faceplate further including at least one curved ridge portion extending through said screw hole of said backing plate to fix said faceplate to said backing plate, said rectangular faceplate assembly being semi-permanently attached to said tubular housing through rigid engagement of said attachment means between said rectangular faceplate and said backing plate;

said backing plate further including means for facilitating separation of said rectangular faceplate from said backing plate to enable said rectangular faceplate assembly to be removed from said tubular housing so as to expose said attachment means for attachment of an alternative faceplate assembly to said tubular housing; and a circular faceplate assembly having means engageable with said attachment means upon removal of said rectangular faceplate assembly from said tubular housing for positioning said circular faceplate assembly on said tubular housing as said alternative faceplate assembly and said circular faceplate assembly further including at least one aperture aligning with said threaded bore upon positioning of said circular faceplate assembly on said tubular housing, such that said circular faceplate assembly is rigidly secured to said tubular housing by threading a set screw through said aperture into said threaded bore.

* * * * *